United States Patent [19]

Vessey

[11] 4,189,798

[45] Feb. 26, 1980

[54] FOAM MATTRESS WITH FLOATATION TORSO SUPPORT

[76] Inventor: Donald C. Vessey, 7331 Kolb Pl., Dublin, Calif. 94566

[21] Appl. No.: 898,115

[22] Filed: Apr. 20, 1978

[51] Int. Cl.[2] ..... A47C 27/08; A47C 27/14

[52] U.S. Cl. ..... 5/451; 5/481; 428/315

[58] Field of Search ..... 5/370, 371, 345 R, 355, 5/365, 367, 349, 350, 451, 452, 481, 441; 428/315

[56] References Cited

U.S. PATENT DOCUMENTS

| | | | |
|---|---|---|---|
| 3,702,484 | 11/1972 | Tobinick et al. | 5/370 |
| 3,707,735 | 1/1973 | Carson, Jr. | 5/370 |
| 3,789,442 | 2/1974 | Tobinick | 5/371 |
| 3,864,768 | 2/1975 | Fraige et al. | 5/371 |
| 4,038,712 | 8/1977 | Miller | 5/452 |
| 4,062,077 | 12/1977 | Autrey et al. | 5/370 |

*Primary Examiner*—Alexander Grosz
*Attorney, Agent, or Firm*—James R. Cypher

[57] ABSTRACT

A sleeping mattress consisting of multiple layers of foam material having different densities and structural characteristics with sealed chamber formed therein for receiving a flexible but inelastic liquid filled container. The sealed chamber is located in the torso supporting area of the mattress only. The foam layers supporting and enclosing the sealed chamber are bonded to one another so that the sides of the chamber provide sufficient lateral support to the liquid filled container to provide buoyant support to the torso portion of the body in a recumbent position.

11 Claims, 8 Drawing Figures

FOAM MATTRESS WITH FLOATATION TORSO SUPPORT

BACKGROUND

About one third of one's lifetime is spent sleeping and a not insignificant effort has been spent attempting to achieve comfort during this time period. Many inventors have attempted to approximate the comfort that one experiences in floating in a body of water such as the Great Salt Lake in Utah. It is believed that the California Indians spent the better part of cold winter days semi floating in pools of hot mud fed by the natural warm springs. The so called "water bed" has become popular, especially in the State of California. Water beds have taken two approaches; those that provide a "floatation" or "buoyancy" effect, and those that result in a "hammock" effect. The first efforts known to Applicant to provide a "floatation" effect is disclosed in White, U.S. Pat. No. 184,487, Nov. 21, 1876. White disclosed a plurality of water tight sacks instead of a "single rectangular oblong air and water tight sack". The White bed consisted of a rigid perimeter and the entire bed was filled with the water sacks. The rigid border probably provided a "floatation" effect. On June 15, 1971, Hall received U.S. Pat. No. 3,585,356 for a water bed consisting of a single flexible substantially inelastic bladder contained by a perimeter rigid frame. Hall, appears to be the first to fully explain the "floatation" effect which results from the use of a frame which provides lateral support to the flexible inelastic bladder. Hall filled the entire bed with water resulting in an extremely heavy piece of furniture. The entire body of the person was supported on the inelastic water bladder.

The "hammock" effect water bed is discussed in the Labianco patent U.S. Pat. No. 3,840,921. Labianco taught that if a person lies on a pillow type water bag which is not supported on its sides, the top of the water bag is placed in tension and "it will create conventional bed pressure points, and will not conform and adjust properly to the different weight proportions of the upper and lower torso of the user." In effect, the body is supported in a "hammock" type attitude.

Both the laterally supported "floatation" beds and the "hammock" type non-laterally supported beds have the problem of excessive weight. More recently a great deal of activity has centered on the problem of reducing weight by providing air or foam rubber or plastic perimeters. Examples of such reduced weight beds are taught by Tobinick in his U.S. Pat. No. 3,702,484, U.S. Pat. No. 3,789,442 and 3,815,165; and Tinnel U.S. Pat. No. 4,015,299. All of these patents lack sufficient structure to provide the necessary lateral support to the flexible water container to result in a "floatation" type support. All of these beds which are combinations of unconnected foam materials, water containers and support sheathes provide a "hammock" type of support.

Reduction of mattress weight by replacing portions of the water area with lightweight foam materials has created a comfort problem in that a person lying on beds constructed in the manner of Tobinick, U.S. Pat. No. 3,789,442 and Tinnel, U.S. Pat.No. 4,015,299 can feel the edge of the foam material where it borders the cavity holding the flexible water bladder. This problem can be overcome, but not with foam mattresses which have cavities which do not provide sufficient lateral support. Hall, supra, taught that lateral support about the perimeter of the water bladder was essential. Without lateral support, a body resting therein sinks to an undesirable depth in the water. If the legs are resting on the foam at an elevation much higher than the heavier portions of the body such as the hips or shoulders, it gives the person an uncomfortable feeling and in addition he will feel the boundry between the foam and the cavity holding the water bag. This disparity in vertical displacement is even accentuated in Tobinick, U.S. Pat. No. 3,789,442 because his cavity walls are slanted.

Finally, the prior art mattresses having foam material areas and water supported areas failed to recognize the great difference in evenness of body weight and the pressure points which occur at the hips and shoulders. Under these pressure points, foam material is more compressed than it is under the arms or legs. This unevenness in support can cause discomfort over protracted periods of time unless the sleeper shifts his weight. This unevenness of support is especially apparent in Tobinick U.S. Pat. No. 3,789,442 in which the hips and legs are supported on the water bag and the shoulders and arms are supported on foam material. While the Tobinick hospital bed had the advantage that the upper portion can be raised from the horizontal without disturbing the water cavity, the level of comfort in the hips and the shoulders is quite different.

SUMMARY OF THE INVENTION

The gist of the present invention is to provide a lightweight mattress which takes into consideration the different weight proportions of the body and combines the advantages of foam materials with the advantages of floatation effect water support to give a greater uniformity of comfort level to the different portions of the body than has ever been achieved heretofore.

An object of the present mattress is to construct the mattress so that it is impossible for a person to feel the dividing line between the portions supported by foam and the portions supported by water.

A further object is to provide a mattress so uniform in comfort level that the legs and head appear to be supported with the same firmness as the pressure points under the hips and shoulders.

Still another object is to provide a mattress which can be used by many persons who cannot ordinarily sleep on standard water beds.

The above objects are achieved in a surprising way. First, the torso only is supported by a combination of foam and water, and the legs and head are supported by foam only.

Secondly, the torso is supported so as to achieve a "floatation" effect by supporting the water bag at its perimeter without the use of wood or metal ridge frames as taught by the prior art. Rather, the necessary lateral support is achieved by securing all of the layers of foam together so that the perimeter of the sealed chamber containing the water bladder is completely laterally held at both its bottom and top perimeter.

Finally, the characteristics of the foam materials are carefully chosen to match the support requirements for the different parts of the body.

DESCRIPTION OF THE PREFERRED EMBODIMENTS

Figure 1:
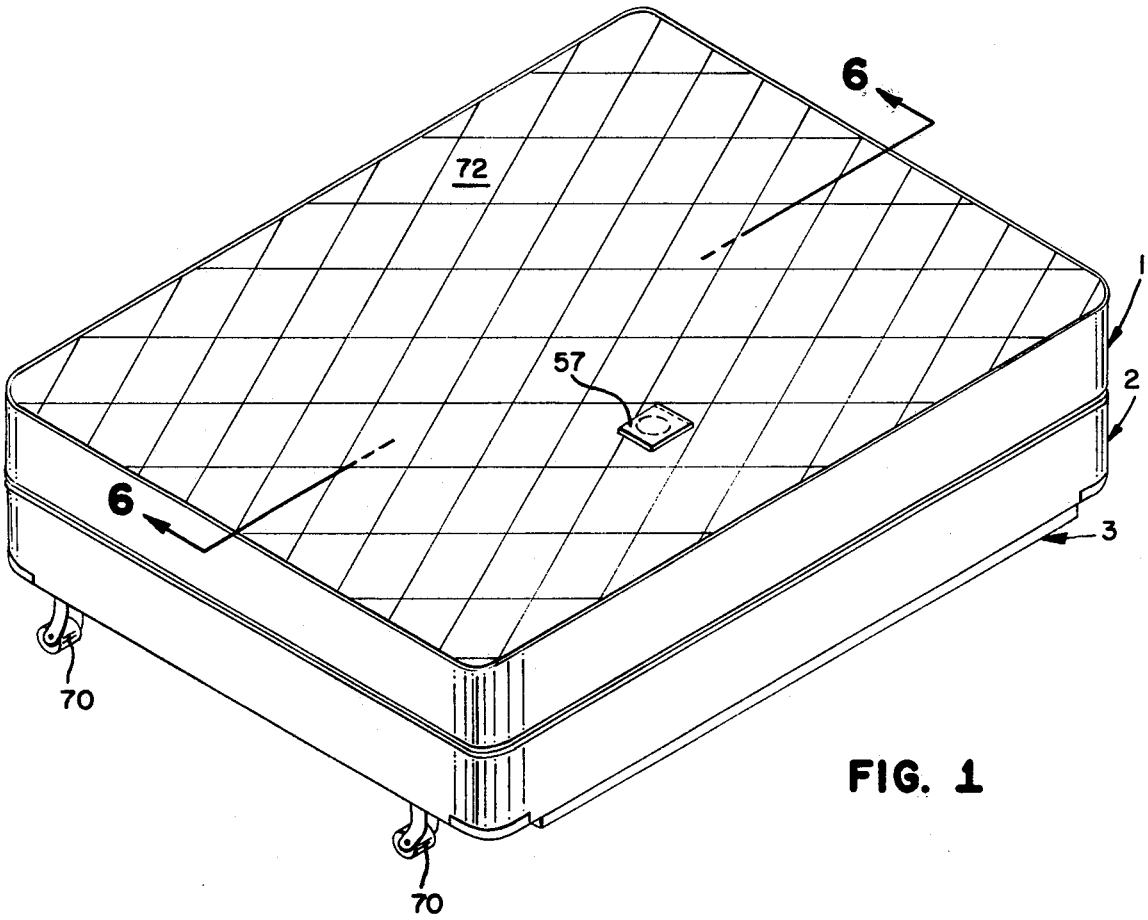
FIG. 1 is a perspective view of the mattress of the present invention supported on a base support.

As illustrated in FIG. 1, the mattress 1 of the present invention has the outward appearance of a standard foam or spring mattess. The mattress preferably rests upon a base 2 which corresponds in appearance to the standard box spring. The metal bed carrier 3 appears to be standard but should be of slightly sturdier construction to carry the slightly increased weight of the mattress.

Figure 2:
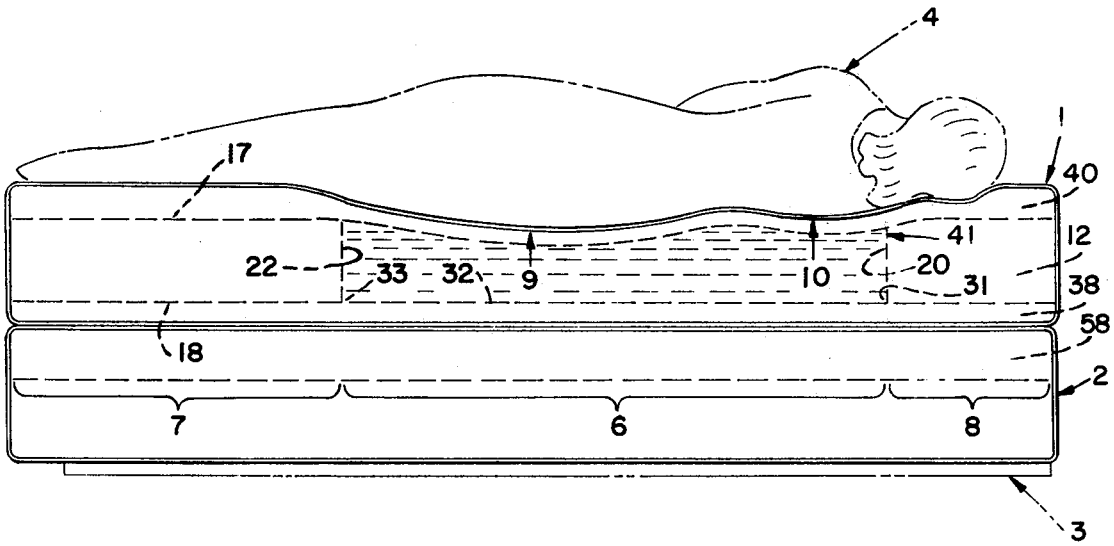
FIG. 2 is a side view of the mattress of FIG. 1 with a person lying on the bed to show the relative positioning of the mattress elements in relation to the body.

The uniqueness of the mattress is illustrated in FIG. 2 in which a person 4 is shown lying on the mattress. The mattress as shown in FIG. 2 is divided into three areas; a portion 6 which carries the torso of a person and portions 7 and 8 which carry the legs and head. Arrow 9 indicates the pressure point area of the hips, and arrow 10 indicates the pressure point area of the shoulders.

Figure 3:
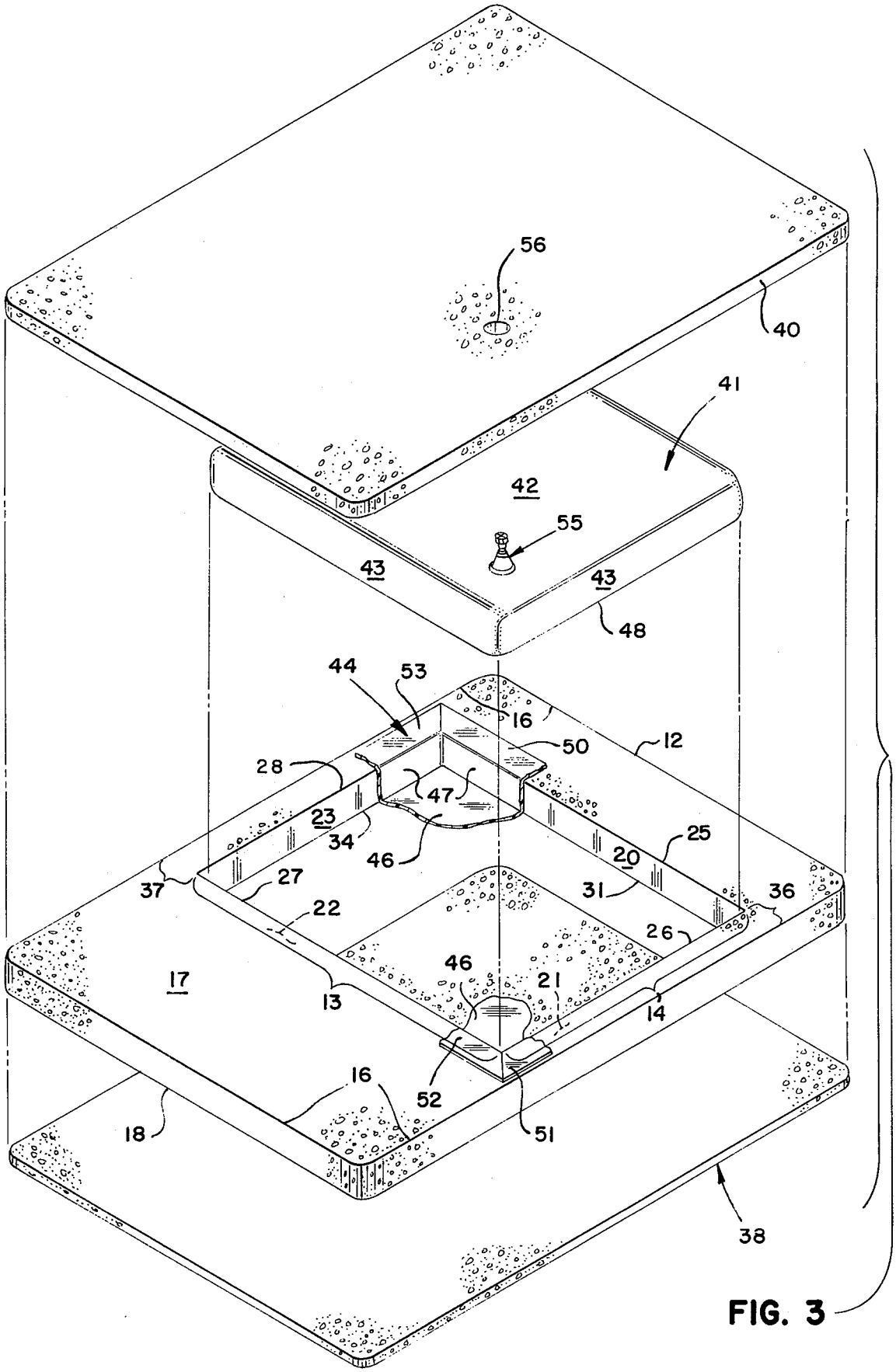
FIG. 3 is an exploded perspective view showing the elements of the mattress of FIG. 1.
Figure 5:
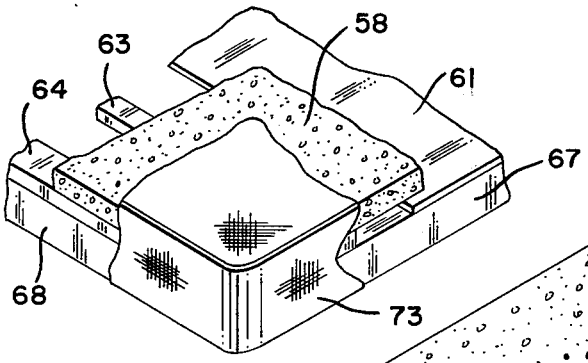
FIG. 5 is a partial perspective view of a portion of the base with the elements assembled.

The main elements of the mattress are illustrated in FIG. 3. The key element is a first foam material member 12 which has an open area defined by brackets 13 and 14 which generally corresponds with the previously identified torso area of FIG. 2. The outer perimeter 16 of the foam member substantially registers with the mattress and may have any shape desired; rectangular, square, circular or of any other geometric shape feasible. The foam material has a generally uniform thickness and is formed with an upper planar surface 17 and a lower planar surface 18. The word planar may here include a surface which is corrugated, waffled or otherwise patterned so long as other surfaces or matching elements are similarly patterned so that they can be joined by cementing or other means of securely bonding the two surfaces one to another.

The torso area 6 indicated by brackets 13 and 14 is an opening which is formed completely through the foam material of member 12 and includes inner walls 20, 21, 22 and 23. Preferably the walls are generally vertical to the plane of the upper and lower surfaces. The opening in the foam creates an upper perimeter edge opening designated 25, 26, 27 and 28 and a lower perimeter edge opening designated 31, 32, 33 and 34. Placement of the opening is such that the torso of a person will rest above the opening so that the hips and shoulders will protrude into this opening. Foam borders designated by brackets 36 and 37 extend on either side of the opening. Preferably the side borders are about four inches (10.16 cm). This width will provide sufficient lateral structure to obtain the floatation effect required and also provides sufficient width for a person to sit on the side of the mattress without substantially engaging the floatation area of the mattress. The head portion 8 is generally wider than the side borders and may be approximately 12" (30.48 cm). The width is chosen so as to support the head. The lower or leg portion 7 of the foam member is dimensioned to support the legs of a person and varies in length depending upon the size of the mattress. The foot portion may have a length of 24" (60.96 cm) for full length; 29" (73.66 cm) for queen length, and 33" (83.82 cm) for king size. Full width of the mattress may vary with the style; Eastern King 76" (193.04 cm); Western King 72" (182.88 cm); Queen 60" (152.4 cm); Full 53" (134.62 cm); and twin 38" (96.52 cm). For purposes only of standarization, a practical length of the opening is 39" (99.06 cm).

A bottom sheet member 38 dimensioned to register with the first foam member is secured thereto over substantially the entire area of the lower surface 18 of the first foam member. While theoretically it would be possible to omit some areas of fastening between the two members, for practical purposes substantially the entire area is fastened. The essential portion which must be securely fastened as by cementing is the border edge 31–34 and the area immediately adjacent. Fastening of this area is the key to lateral holding and the buoyant effect later to be discussed.

While the bottom sheet member could be a thin sheet member of plastic film, preferably the member is a foam member having a thickness of approximately 1" (2.54 cm). Preferably, the sheet should be a structural foam capable of sustaining continuous loads of greater magnitude of given load deflection than the first and second foam members. A commercial grade of foam known by the designation P-94 is suitable. This foam has an indentation load deflection of 25% with a load of 31 to 45 lbs. over a 100 square inch (645.1 $cm^2$) platten. Foam density of 1.8 pounds per cubic feet is satisfactory. The first foam member is formed from a foam having a softness and density selected to give approximately the same feeling of softness and comfort support to the legs of a person when combined with the softness characteristics of a second member described below as the feeling of softness and comfort support experienced by the torso of a person which is supported by the liquid container in combination with the overlying second member.

A second high resiliency foam material member 40 dimensioned to substantially register with the first foam member is secured to substantially the entire area adjacent the inner perimeter 25–28 of the upper surface of the first foam member. The secured area must be sufficient to hold the inner perimeter to achieve the necessary floatation effect. Preferably, the second foam member is a two inch high resilient foam laminated to the entire top surface of the first foam member 12. One suitable foam is HR-23 Foam which has a 25% ILD (indentation load deflection) of 20–23 and a density of 2.6 pounds per cubic foot. Laminating the first and second foam members near the outer periphery 16 also prevents the soft foam sides from bulging outwardly. The use of the second foam member also provides an even surface to help bridge any separation between the water container and the inner opening in the first foam member. Further, use of the second foam member as an insulator eliminates the need for heating devices to heat the water in the container.

A flexible, substantially inelastic liquid container 41 is provided for receipt within the chamber formed by the first foam member opening, the bottom sheet member and the second foam member. The container is dimensioned so that when filled with liquid, it occupies substantially the entire opening area in the first foam member. The container is made from the standard plastic material used in making the water bladders for standard water beds. In some instances, it may be desirable to fit a foam member into the opening in the first foam member above the liquid container, but in most instances the liquid container should be dimensioned so that when filled, the top wall 42 of the container is substantially on the same plane as the upper planar surface of the first foam member. The container side walls 43 abut walls 20–23 of the first foam member.

As in all water beds, a safety liner 44 is desirable. The liner is illustrated in FIG. 3 and consists of an impervious flexible sheet member which includes a bottom 46 and sidewall portions 47 dimensioned to line the bottom and sides of the chamber formed with the mattress. Unlike other safety liners which are only designed with only the function of catching the fluid should there by a puncture in the water container, the bottom 46 of the liner is preferably connected to the bottom sheet member 38 as by a plastic cement and the bottom wall 48 of the fluid container is connected to the liner so as to further prevent movement of the sidewalls of the container to enhance the "floatation" effect. Further lateral support is provided by also cementing the sides 47 of the liner to the sidewalls 20–23 of the chamber opening. Preferably, the safety liner is formed with flap members 50, 51, 52 and 53 which are attached to the upper surface of the first foam member. The flaps further provide lateral support to the sides of the fluid container. Again, the greater lateral support gives the necessary floatation effect.

The mattress is provided with a valve means 55 which is connected to the liquid container for filling or emptying the container. A passage 56 is formed in the mattress connecting the outer surface of the mattress and the chamber for filling the liquid container. The valve is constructed so that it folds upon itself in a telescoping manner so that it does not protrude above the top surface of the mattress. A valve cover 57 may be provided to cover the valve passage.

Figure 4:
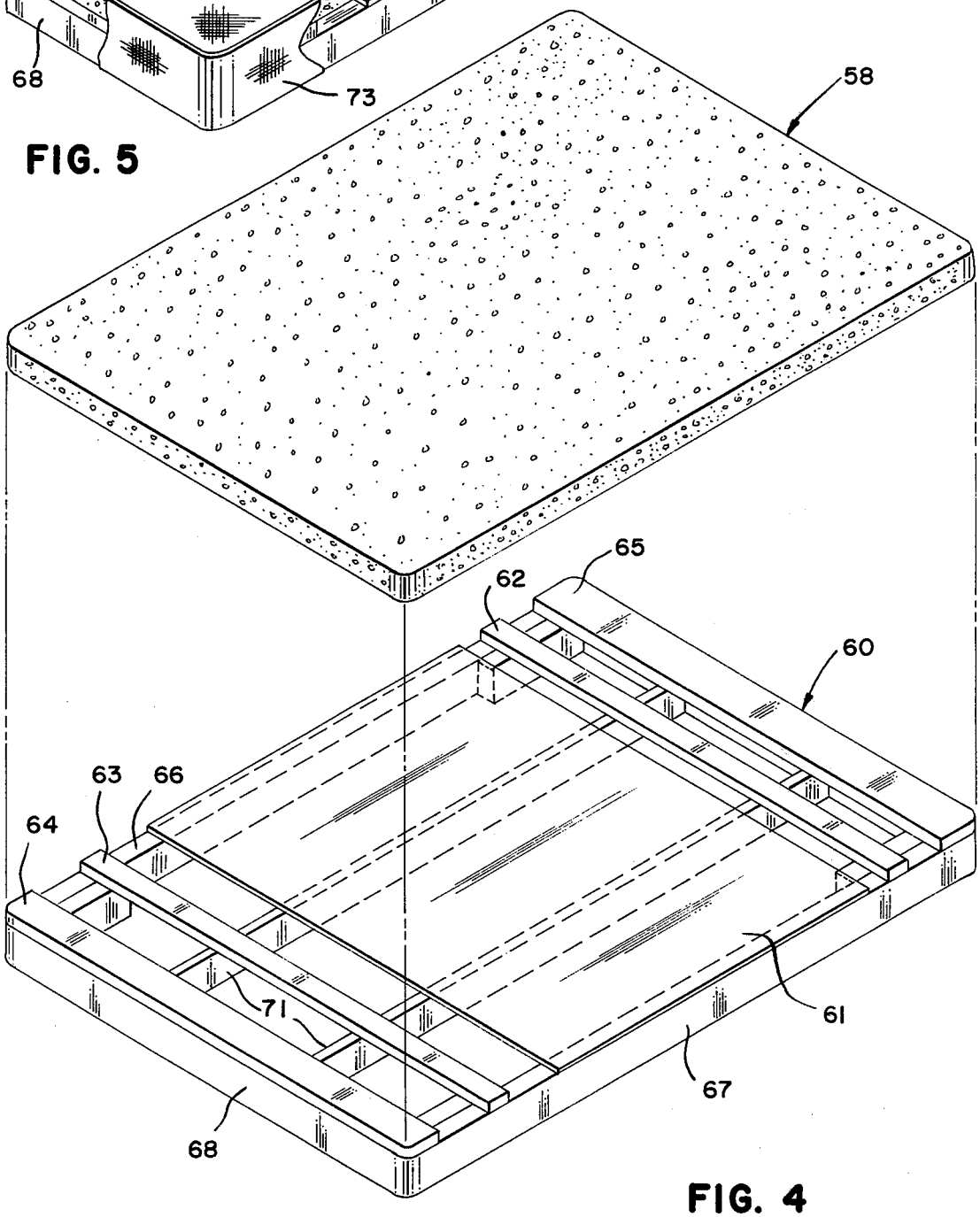
FIG. 4 is an exploded perspective view showing the elements of the base shown in FIG. 1.

Referring to FIG 4. a base foam member 58 dimensioned to register with the bottom sheet member 38 is provided. This base member has a substantially uniform thickness of about three inches (7.62 cm). The purpose of the foam base is to insure against "bottoming out" when the water in the container is totally displaced.

Most users of the mattress will wish to raise it above the floor level. FIG. 4 illustrates a base frame 60 having a substantial thickness dimensioned to register with the base foam member 58 and having a generally planar continuous flat surface member 61 located to underlie substantially the entire area of the mattress chamber. The flat member 61 may be ½ inch (12.7 mm) particle board. It is unnecessary to provide continuous support under the entire mattress so that only a single cross member 62 such as a 1"×2" (2.54 cm×5.08 cm) board is required at the head and a similar board 63 is required at the foot. Cross boards 64 and 65 such as a 1"×4" (2.54×10.16 cm) provide the necessary lateral ridigity. Side boards 66 and 67 consisting of 2"×4"'s (5.08×10.16 cm) rest on the bed frame. End members 68 and longitudinal members 71 provide longitudinal support.

A dramatic total weight reduction is effected by constructing a mattress as set forth in this specification. The mattress, also known as a Liquidtron Bed compares with other beds as follows:

WEIGHT/GALLON COMPARISON

| CONVENTIONAL WATER BED | HIBRED WATER BED | LIQUITRON BED |
|---|---|---|
| KING 273 gal/2200 lbs. | 92 gal/745 lbs. | 43 gal/360 lbs. |
| QUEEN 205 gal/1760 lbs. | 78 gal/600 lbs. | 35 gal/293 lbs. |
| FULL 155 gal/1240 lbs. | 60 gal/480 lbs. | 30 gal/253 lbs. |
| TWIN 122 gal/979 lbs. | 44 gal/360 lbs. | 20 gal/169 lbs. |

Figure 6:
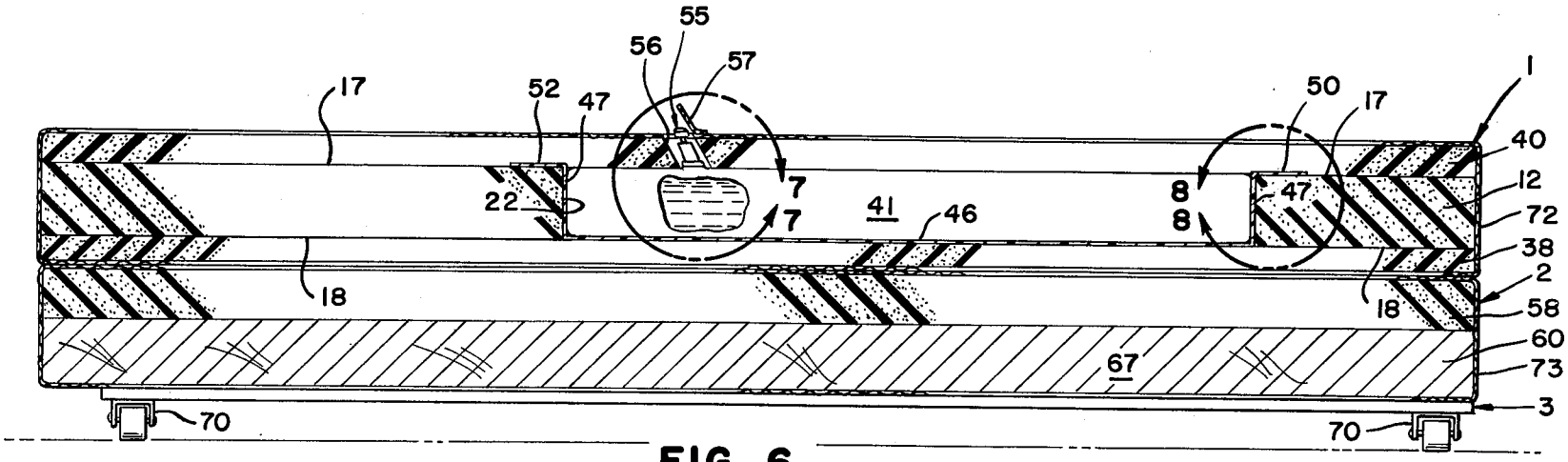
FIG. 6 is a cross sectional view of the mattress and base shown in FIG. 1, taken along line 6—6.
Figure 8:
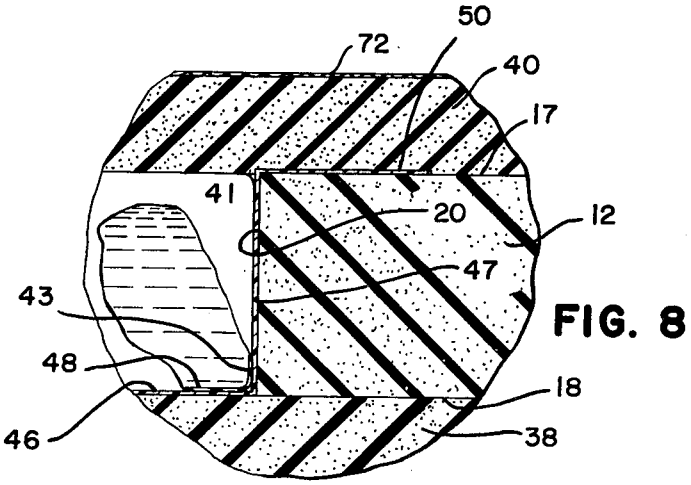
FIG. 8 is an enlarged cross section taken along line 8—8 of FIG. 6.
Figure 7:
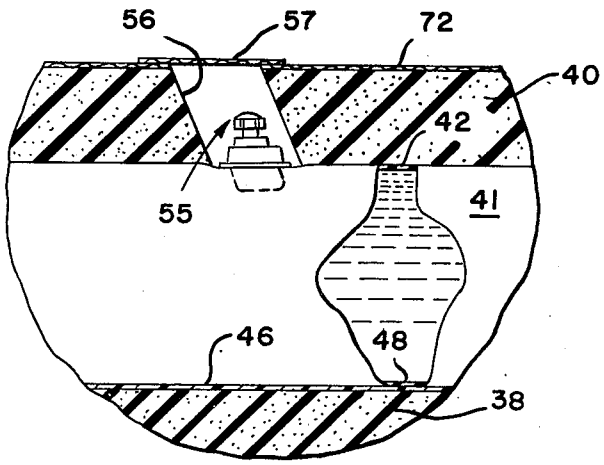
FIG. 7 is an enlarged cross section taken along line 7—7 of FIG. 6.

Because of the very low total weight of the mattress and base, the entire bed may be placed on a metal frame 3 with casters 70 as shown in FIG. 6. The frame need only be somewhat stronger than the standard frame for conventional beds.

The mattress may be covered with a cloth fitted cover 72 so that except for the valve opening, the mattress appears to be a standard foam mattress. The base foam member and wood frame may also be covered with fabric 73 and therefore looks like the standard box spring.

In practice, the mattress is sold without water so that it is very light weight and may be transported in the same manner as any foam mattress. When the mattress is ready for use, it is filled with liquid such as water.

As shown in FIG. 2, only the torso is supported by the liquid, whereas the head and legs supported by the foam portions of the mattress. Since the liquid container is supported laterally, the pressure points under the hips and shoulders do not sink into the chamber opening very far, but instead "float" as in a standard water bed.

Lateral support of the liquid container and the careful selection of the foam layers renders it practically impossible for the user to determine the perimeter of the opening. All parts of the body appear to be uniformly supported even though the actual support is far different.

The unique construction of the mattress solves a problem inherent in standard water beds heretofore unsolved. Many people find it difficult to become accustomed to standard water beds and some never can adjust to the wave motion. This is caused in part by the fact that when the head rests on the liquid filled bladder, the inner ear senses the slight but constant movement of the water. The mattress as constructed according to this specification, however, keeps the sensitive inner ear off the liquid container. Instead the head rests on foam only and the slight movement of the fluid in the container goes undetected.

When the body is at rest, the first foam member 12 beneath the legs and the head is not deflected. Only the second member 40 is deflected. The liquid container permits the hips and shoulders to sink to an elevation below the elevation of the legs and head so that the mattress provides a particularly comfortable surface to those that like to sleep on their sides.

The mattress is constructed with all parts bonded together and there is no assembly required by the user as in standard water beds or hybrid water beds which consist of foam parts, wood parts and a water bag. The use of a separate heater element for the water is not required because of the insulation provided by the second foam member 40.

The unique construction of the side portions of the mattress make it easier to sit on the edge of the bed. In a standard water bed, it is difficult to sit on the edge of the bed because the water gives away and there is a tendency to fall into the bed. Many attempts have been made to alleviate this situation by providing a foam or air mattress perimeter. The air mattresses have the usual problems of maintaining air pressure and the hybrid water and foam border beds do not provide sufficient support because of the tendency of the foam to bulge into the water container. Because all of the elements of the present mattress are laminated together, a firm support is provided to the entire perimeter of the mattress.

Hybrid water beds with water filled interiors and foam borders have a problem in that the portion of the body on the water filled area can move laterally while other parts of the body resting on the foam remain stationary. This problem has been obviated by the fact that the second foam member 40 covers the entire mattress and is laminated to the first foam member 12.

I claim:

1. A laminated mattress assembly having an area and perimeter dimensioned for use as a sleeping bag comprising:

a. a first foam material member having an area and outer perimeter substantially registering with said area and perimeter of said mattress assembly, having generally uniform thickness, formed with upper and lower planar surfaces, and formed with an opening therethrough defined by inner perimeter walls dimensioned and located within said mattress assembly area to underlie the torso only of a person and leaving a substantial structural supporting border area between said inner perimeter walls and all points of said outer perimeter including a head carrying portion and a leg carrying portion;

b. a bottom sheet member dimensioned for coextensive registration with said first foam member and secured by bonding against relative lateral displacement substantially over said entire lower surface area and specifically adjacent said inner perimeter of said lower surface of said first foam member;

c. a second high resiliency foam material member dimensioned for substantially coextensive registration with said first foam member and secured by bonding against relative lateral displacement over substantially said entire upper surface area and specifically adjacent said inner perimeter of said upper surface of said first foam member;

d. a flexible, substantially inelastic liquid container for receipt and containment within said inner perimeter walls of said first foam member supported by a portion of, said bottom sheet member and underlaying a portion of said second foam member, and dimensioned so that when filled with liquid it occupies substantially the entire opening in said first foam member;

e. valve means connected to said liquid container for filling or emptying said container;

f. a passage formed in said second foam mattress connecting the outer surface of said mattress assembly and said chamber for filling said liquid container; and g. said bottom sheet member and said second foam member have substantial resistance to elongation in all lateral directions so that when a weighted body rests on said mattress assembly said bottom sheet member and said second foam member are tensioned and resist lateral displacement of said inner perimeter walls.

2. A mattress assembly as described in claim 1 wherein:

a. said bottom sheet member is a structural foam having a substantial thickness capable of sustaining continuous loads of greater magnitude of given load deflection than said first and second foam members.

3. A mattress assembly as described in claim 1 comprising:

a. an impervious flexible sheet member including bottom and sidewall portions dimensioned for lining the bottom and sides of said opening formed within said first foam member and secured to said bottom sheet member and to said inner perimeter walls of said first foam member so as to prevent relative lateral displacement therebetween.

4. A mattress assembly as described in claim 3 wherein:

a. said impervious sheet member is formed with a flap member surrounding the sides of said chamber; and b. a substantial portion of the side wall portions of said impervious member is attached to said inner sidewalls of said opening in said first foam member, and a substantial portion of said flap member is attached to said upper surface of said first foam member.

5. A mattress assembly as described in claim 4 comprising:

a. a substantial portion of said bottom portion of said impervious member is attached to said bottom sheet member.

6. A mattress assembly as described in claim 1 wherein:

a. said second foam member is formed from high resiliency foam having a softness greater than the softness of said first foam member.

7. A mattress assembly as described in claim 6 wherein:

a. said first foam member is formed from a foam having a softness and density selected to give approximately the same feeling of softness and comfort support to the legs of a person when combined with softness characteristics of said second member as the feeling of softness and comfort support experienced by the torso of a person which is supported by the liquid container in combination with the overlying second member.

8. A mattress assembly as described in claim 1 comprising:

a. valve means connected to said liquid container for filling or emptying said container; and b. a passage formed in said mattress connecting the outer surface of said mattress and said chamber for filling said liquid container.

9. A mattress assembly as described in claim 8 comprising:

a. a base frame having a substantial thickness dimensioned to register with said base foam member and having a generally planar continuous flat surface member located to underlie substantially the entire area of said opening in said first foam member.

10. A mattress assembly as described in claim 1 wherein:

a. said liquid container is dimensioned so that when filled, a top wall of said container is substantially on the same plane as said upper planar surface of said first foam member.

11. A mattress assembly as described in claim 1 comprising:

a. said inner perimeter walls of said opening in said first foam member are substantially vertical;

b. an impervious flexible sheet member including bottom and sidewall portions dimensioned for lining the bottom and sides of said opening formed within said first foam member;

c. said impervous sheet member is formed with a flap member surrounding the sides of said opening;

d. a substantial portion of the side wall portions of said impervious member is attached to said inner sidewalls of said opening in said first foam member, and a substantial portion of said flap member is attached to said upper surface of said first foam member; and e. a substantial portion of said bottom portion of said impervious member is attached to said bottom sheet member.

* * * * *

UNITED STATES PATENT AND TRADEMARK OFFICE

CERTIFICATE OF CORRECTION

PATENT NO. : 4,189,798

DATED : February 26, 1980

INVENTOR(S) : DONALD C. VESEY

It is certified that error appears in the above-identified patent and that said Letters Patent are hereby corrected as shown below:

Inventor's name should read --- DONALD C. VESEY --- and [Donald C. Vessey] deleted.

In Column 8, line 47, Claim 8 should be deleted to read as follows:

8. A mattress assembly as described in claim 1 comprising:

a. a base foam member dimensioned to register with said bottom sheet member and having a substantially uniform thickness.

Signed and Sealed this

*Seventeenth* Day of *June 1980*

[SEAL]

*Attest:*

SIDNEY A. DIAMOND

*Attesting Officer*

*Commissioner of Patents and Trademarks*